United States Patent [19]

Yoshikawa et al.

[11] 4,082,980

[45] Apr. 4, 1978

[54] SPARK PLUG CAP PROVIDING A CAPACITOR IN PARALLEL WITH THE SPARK CAP

[75] Inventors: Masazi Yoshikawa; Tomoe Sawada, both of Kyoto, Japan

[73] Assignee: Murata Manufacturing Co., Ltd., Kyoto, Japan; a part interest

[21] Appl. No.: 656,723

[22] Filed: Feb. 9, 1976

[30] Foreign Application Priority Data

| | | |
|---|---|---|
| Feb. 13, 1975 | Japan | 50-21425[U] |
| May 15, 1975 | Japan | 50-65019[U] |
| Feb. 17, 1975 | Japan | 50-66088[U] |
| Jun. 12, 1975 | Japan | 50-81296[U] |

[51] Int. Cl.[2] ..... H01T 13/04; H01T 13/40

[52] U.S. Cl. ..... 315/59; 313/135; 315/71; 339/26

[58] Field of Search ..... 315/58, 59, 71, 227 R; 313/49, 51, 134, 135; 339/26, 149 S, 213 S, 218 S

[56] References Cited

U.S. PATENT DOCUMENTS

| | | | |
|---|---|---|---|
| 2,376,362 | 5/1945 | Kasarjian | 315/58 X |
| 3,683,232 | 8/1972 | Baur | 315/95 X |

FOREIGN PATENT DOCUMENTS

| | | | |
|---|---|---|---|
| 1,307,681 | 9/1962 | France | 315/58 |

*Primary Examiner*—Eugene R. LaRoche

*Attorney, Agent, or Firm*—Morgan, Finnegan, Pine, Foley & Lee

[57] ABSTRACT

A spark plug cap for use on a spark plug of an internal combustion engine to much intensify sparking across the gap between central and ground electrodes of the spark plug. The spark plug cap includes an insulating body having a connector provided at its one end for mechanically connecting the cap to the spark plug. An electrical conductor extends through the insulating body for supplying high-tension ignition current to the central electrode of the spark plug. At least one capacitor unit is supported within the insulating body and electrically connected across the gap between the spark plug electrodes.

22 Claims, 15 Drawing Figures

Fig. 1
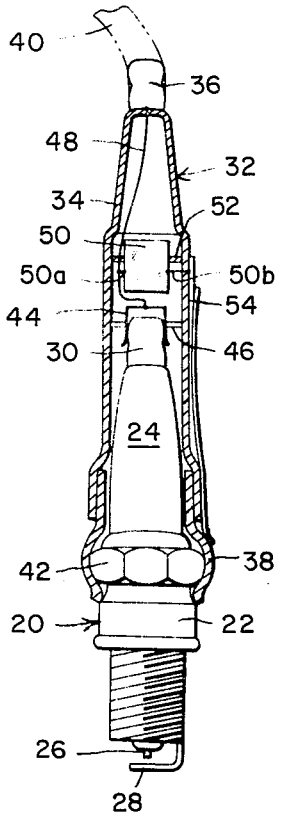
Fig. 4
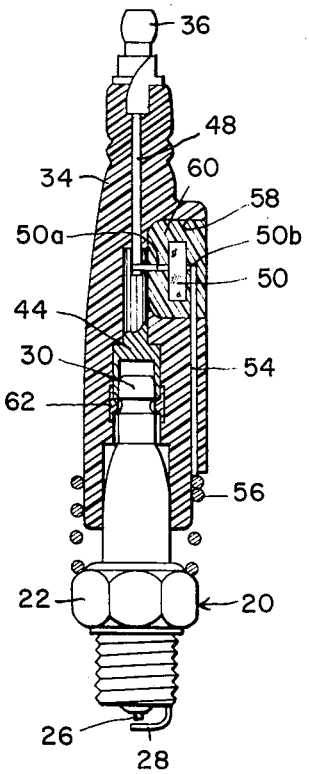
Fig. 3
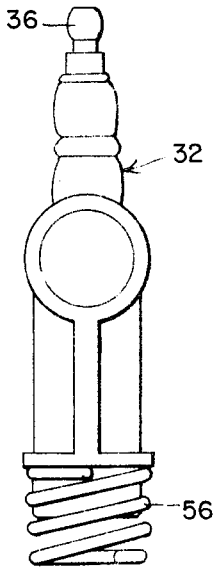
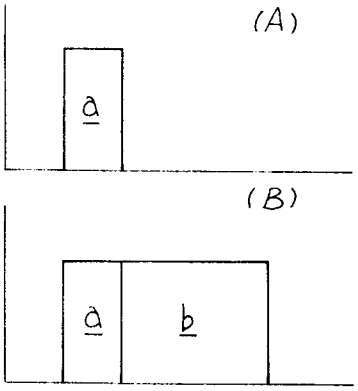
ELECTRICAL ENERGY AVAILABLE AT THE GAP
Fig. 2
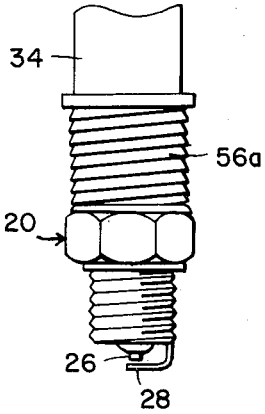
Fig. 5
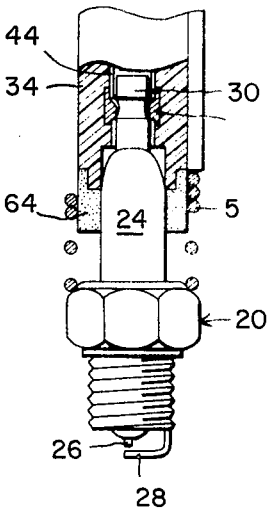
Fig. 6

SPARK PLUG CAP PROVIDING A CAPACITOR IN PARALLEL WITH THE SPARK CAP

BACKGROUND OF THE INVENTION

Spark plugs are universally used in internal combustion engines to ignite compressed fuel-air mixture in the cylinders of internal combustion engines. The spark plug includes a pair of spaced electrodes, between which a high-potential electric current is passed from the secondary winding of the ignition coil to produce an ignition initiating spark across the gap between the electrodes.

In an attempt to improve combustion efficiency, efforts have been directed to strengthen or intensify the sparking at the spark plug gap. The expected results of the intensified sparking is almost perfect combustion of the fuel charge taking place in the engine cylinders, which in turn contributes to improved engine output and cleaner combustion or exhaust gases. The latter contribution is particularly advantageous nowadays when strict antipollution control is being imposed on automobile emission gases throughout the world. One prior attempt to strengthen the sparking at the spark plug gap is to introduce a capacitive device into the firing circuit of the ignition system. The capacitive device provides added electric energy across the spark plug gap resulting in intensified spark discharge thereacross. Baur U.S. Pat. No. 3,683,232 proposes to form a capacitor of high capacitance connected in parallel to the spark plug gap by fitting the spark plug cap on the spark plug. The capacitor includes the widened electrode 15 and the conductive screening shell 16 placed, respectively, within and around the plastic insulating body 12 which serves as a dielectric separating two electrodes. However, the spark plug cap of the aforementioned Baur U.S. patent has many disadvantages which make it extremely difficult to obtain the desired results. To mention a few, for example, the plastic insulating body of the cap fitted on the spark plug undergoes earlier deterioration under high temperature heat and severe vibration generated in the engine, which in turn causes a decrease in the capacitance of the capacitor. Since the capacitance has a critical effect on the strength of the spark discharge across the plug gap, the earlier decrease of the capacitance is apparently a detrimental factor contributing toward unacceptability of the Baur spark plug cap. The fact that the spark plug cap in the fitted condition is inevitably put to severe heat and vibration also poses other problems for the plug cap capacitor. For one thing, the capacitor electrodes, especially the conductive screening shell tends to be brought out of intimate engagement with the outer surrounding wall of the insulating body forming more or less an air gap between the screening shell electrode and the dielectric body. For another thing, there is a strong possibility of the plastic insulating body being broken apart. These are also the factors that prevent the Baur cap from being universally employed on the spark plugs since in either of the above cases the plug cap capacitor gets out of order. In short, the Baur spark plug cap is fragile in nature and lacks mechanical as well as electrical stability which is essential for the cap to be used on heat and vibration transmitting spark plugs. In addition, the capacitor device of the Baur cap is bulky in structure and is not effectively protected against moisture and heat.

SUMMARY OF THE INVENTION

With the above noted problems in mind, it is an object of the invention to provide an improved device for use on a spark plug of an internal combustion engine to intensify sparking across the spark gap.

It is a further object of the invention to provide an improved spark plug cap for an internal combustion engine to intensify sparking across the spark gap which is highly resistant to heat and vibration produced in the internal combustion engine.

It is a still further object of the invention to provide an improved spark plug cap for an internal combustion engine to intensify sparking across the spark gap which has at least one capacitor unit of high mechanical and electrical stability incorporated therein.

Briefly stated, according to the invention, there is provided a spark plug cap for use on the spark plug of an internal combustion engine to intensify sparking across the spark plug gap. The cap includes an insulating body formed of such material as fiber reinforced plastics and ceramics. Means is provided in the insulating cap body for mechanically interconnecting the cap to the spark plug. Electrically conductive means extends through the insulating cap body for supplying high-tension ignition current from an ignition system of the engine to a central electrode of the spark plug. At least one separate and individual capacitor unit is supported within the insulating cap body and electrically connected in parallel to the spark gap between the central and ground electrodes of the spark plug. An instantaneous application of a high electrical potential across the spark plug electrodes by the ignition system causes a high-tension ignition current in the visible form of a spark to jump the gap between the electrodes and thus to ignite the compressed fuel-air mixture in the cylinder of the engine. The application of the high sparking potential across the plug electrodes causes, at the same time, the capacitor unit connected in parallel to the spark plug gap to be fully charged. The charged capacitor is then discharged across the electrodes when the spark jumps the spark plug gap providing an additional current flow across the gap. The result is that the spark at the gap is much intensified by the discharging of the parallel capacitor unit.

According to one aspect of the invention, the capacitor unit comprises a pair of metal electrodes insulated from each other by a planar dielectric. According to other aspect of the invention, the capacitor unit comprises a pair of metal electrodes insulated from the each other by a cylindrical dielectric.

BRIEF DESCRIPTION OF THE DRAWINGS

FIG. 1 is a vertical cross-sectional view of a spark plug cap embodying the invention in which a flat type capacitor unit is supported within a hollow cap body;

FIG. 2 is a schematic illustration comparatively showing electric energy available at the gap of spark plugs with and without the cap of the present invention fitted;

FIG. 3 is a side elevational view of a spark plug cap embodying the invention in which a flat type capacitor unit is embedded within an insulating cap body and a coil spring is used for making ground connection to the capacitor unit;

FIG. 4 is a vertical cross-sectional view of the spark plug cap shown in FIG. 3;

FIG. 5 is a partial side elevational view of a spark plug cap similar to that shown in FIG. 3, in which a coil spring with flat, nested turns is used for the ground connection;

FIG. 6 is a partial cross-sectional view of a spark plug cap similar to that shown in FIG. 3, in which a resilient sleeve is attached at the bottom end of the insulating cap body to assist in mechanical interconnection between the cap and the spark plug;

DETAILED DESCRIPTION OF THE PREFERRED EMBODIMENTS

Figure 7:
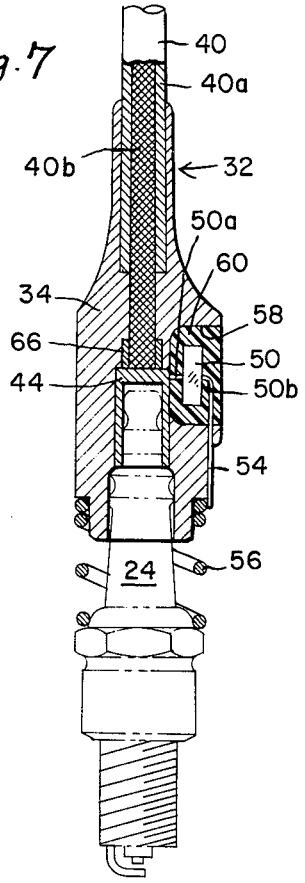
FIG. 7 is a vertical cross-sectional view of a spark plug cap of the invention with a built-in capacitor in which an ignition cable from the ignition system directly extends into the insulating cap body.

Referring now to the accompanied drawings, wherein like reference characters designate like or corresponding parts throughout the several views, there is illustrated in FIG. 1 a spark plug cap according to one preferred embodiment of the invention. The spark plug caps of the invention are designed for use on the existing spark plugs universally used in internal combustion engines. As shown, the spark plug 20 typically includes an outer metal shell 22 with a threaded base and a ceramic insulator 24 sealed into the metal shell, through which a central electrode 26 passes. A ground electrode 28 is fixed to the metal shell 22 and a gap is formed between this electrode and the central electrode 26. Provided at the upper end of the central electrode is a terminal 30 for making electrical connection with the ignition system of the engine.

The spark plug cap 32 comprises a generally cylindrical, hollow body 34 made of suitable insulating material such as fiber reinforced plastics, silicon rubber and ceramics. The cap body 34 has a terminal 36 similar in shape to the plug terminal 30 fixed to its upper end and a generally annular connector 38 at its lower end.

The terminal head 36 is for receiving a high-tension ignition cable 40 from the ignition system. While the annular connector 38 is expected to serve dual functions: one is to mechanically attach the plug cap 32 to the spark plug 20 and the other is to provide an electrical connection between an electric element within the plug cap and the metal shell 22 of the spark plug. Accordingly, the connector is made of a suitable conductive metal into such form as to resiliently grip around the hexagonally shaped surface 42 of the metal shell. One way to provide the connector 38 with the desired resiliency is to cut out one or more axially extending slots in the lower portion of the connector wall.

Fixedly supported within the hollow cylindrical body 34 is a connector socket 44 which is adapted to be fitted over the spark plug terminal 30 when the cap is positioned in place on the spark plug. For this purpose, a suitable support 46 is provided within the hollow body to support the socket 44 in terminal receiving position. A conductor lead 48 extends through the hollow body to electrically connect the cap terminal 36 with the connector socket 44.

According to an important aspect of the invention, at least one separate and individual capacitor unit 50 is held within the hollow insulating body 34. Any of the known solid types such as ceramic capacitors which consists of a pair of metal electrodes insulated from each other by a solid dielectric may be used to advantage for the capacitor unit. In the illustrated spark plug cap, a solid capacitor of flat type is used. A typical flat capacitor now available on market comprises a pair of metal plates attached on opposite sides of a planar dielectric. A support 52 fixedly holds the capacitor unit 50 at a position above the connector socket 44 within the insulating body. The capacitor unit 50 has one terminal **50*a* connected to the conductor lead 48 and the other terminal 50*b* to the annular connector 38 via an outer conductor lead 54**.

With this arrangement, when the spark plug cap 32 is fitted on the spark plug 20 forcing down the annular resilient connector 38 over the hexagonally shaped surface 42 of the spark plug, the plug terminal 30 is snugly received within the connector socket 44 making an electrical connection to the cap terminal 36 via the conductor 48. While at the same time, another electrical connection is established between the capacitor terminal **50*b* and the plug metal shell 22 via the lead 54 and the electrically conductive connector 38 which is now in contact with the metal shell. Thus, the capacitor unit 50 is effectively connected in parallel to the gap between the spark plug electrodes 26 and 28. As pointed out above, the ring connector 38 serves not only to removably attach the plug cap to the spark plug but also to electrically join the capacitor unit 50 with the plug metal shell 22 for grounded connection thereto. With this intent in mind, the ring connector 38 is formed of a conductive metal as discussed hereinabove. However, various other modifications are possible as long as they serve the purposes in question. For example, the connector ring may be formed integrally with the hollow cylindrical body using the same insulating material as the body. A conductive metal piece may then be bonded or otherwise attached to the inner wall of the insulating connector for electrical contact with the plug metal shell and the conductor lead 54** from the terminal 50*b* of the capacitor unit is joined to this conductive metal piece for the ground connection.

With the cap 32 fitted in place on the spark plug 20, the secondary wire in the form of a well-insulated ignition cable 40 from the ignition coil is attached to the terminal head 36 of the spark plug cap. During operation of the engine, a very high voltage induced in the secondary winding of the ignition coil is carried through the ignition cable 40 to the terminal head 36, and from there to the central electrode 26 of the spark plug via the conductor lead 48, connector socket 44 and terminal 30. The application of the high voltage across the central and ground electrodes 26 and 28 causes high-tension current to jump the gap therebetween forming a spark across the gap. This spark in turn ignites the compressed fuel-air mixture in the cylinder of the internal combustion engine. The application of the sparking potential across the plug electrodes causes, at the same time, the capacitor unit 50 in parallel to the spark plug gap to be charged up to a predetermined rated level. The charged capacitor unit is then discharged across the spark plug gap when a spark jumps thereacross after the application of the sparking potential. In other words, the capacitor unit is first charged by the high sparking potential applied across the spark plug electrodes and then discharged when sparking occurs between the electrodes as the result of the applied sparking potential. Thus, the high discharge current from the capacitor unit jumps across the spark plug gap at substantially the same time as the ignition current from the ignition coil jumps thereacross. The result is that the spark across the gap is much intensified by the additional current supply from the charged capacitor unit. FIG. 2 shows schematically the amount of electrical energy available or "consumed" at the spark plug gap to produce a combustion initiating sparking. In a conventional spark plug with no capacitor unit connected in parallel to the gap, the amount of electric energy available at the gap for the sparking is limited to that supplied from the ignition system of the engine and indicated at *a* (see FIG. 2A). While in the spark plug fitted with the novel spark plug cap of the invention, the amount of electrical energy available at the gap is the sum total of the energy *a* from the ignition system and the energy *b* from the charged capacitor unit, the latter being dependent upon the rated capacitance of the capacitor unit employed. As is apparent from the illustration, the additional energy supplied from the capacitor unit greatly contributes to produce the intensified spark across the gap. The capacitance of the capacitor unit may vary according to the rated value of circuit components in the ignition system. However, satisfactory results are obtained for the existing spark plugs by using a capacitor unit with the rated capacitance between 100 to 200 pF.

As mentioned, the spark plug equipped with the noval cap of the invention is capable of producing sparks across the gap, which are much improved in their strength. The intensified sparks at the gap in turn contribute to rapid and ready ignition of the fuel-air mixture in the engine cylinder as well as to complete and efficient combustion thereof. The latter contribution is particularly advantageous in that it leads to improved engine power and clean exhaust gases. The provision of the capacitor unit in parallel to the spark plug gap has additional advantages. For example, residual electromagnetic energy is found in the secondary winding of the ignition coil immediately after each sparking takes place across the spark plug gap. This residual electromagnetic energy has an adverse effect on the operation of the ignition system in that it prevents subsequent current impulse of the desired energy level from being induced in the secondary winding of the ignition coil. However, with the cap fitted spark plug, the undersired residual electromagnetic energy is entirely absorbed in the capacitor unit each time it is induced in the secondary winding, thus causing no detrimental effects on the proper operation of the ignition system.

In FIGS. 3–4, there is illustrated a spark plug caps according to another embodiment of the invention. In the illustrated embodiment, the spark plug cap 32 includes a generally cylindrical cap body 34 formed of suitable insulating material such as fiber reinforced plastics and ceramics. Embedded within the insulating cap body 34 is a connector socket 44 for fittingly receiving the plug terminal 30 when the cap is positioned in place on the spark plug 20. A conductor lead 48 extends axially through the cap body to electrically connect the socket 44 with a terminal head 36 attached at the upper end of the cap body. In place of the resilient connector ring 38 used in the cap of FIG. 1, a resilient coil spring 56 of electrically conductive material is fixedly attached to the insulating cap body 34 as by forcing a few upper turns of the spring over the lower end of the body. A lateral recess 58 is made in the insulating body 34 to accommodate a planar capacitor unit 50. One terminal 50*a* of the capacitor unit is electrically connected to the axial conductor lead 48, while the other terminal 50*b* to the coil spring 56 via a ground conductor 54 axially extending through the body. In order to keep the capacitor unit 50 in place within the cap body, the lateral recess 58 is, after placement of the unit, filled with insulating material 60 which shows intimacy with the insulating cap body such as, for example, epoxy resins. Thus, the capacitor unit 50 is entirely embedded within the body 34 with the result that the capacitor unit is held securely against shock and vibration, and in a moisture-proof manner.

With this arrangement, when the cap 32 is fitted on the spark plug 20, the spark terminal 30 is snugly received in the connector socket 44 with a clamp ring 62 placed around the socket tightly gripping the terminal. Thus, the clamp-socket combination mechanically interconnect the spark plug with the cap while at the same time making electrical connection between the ignition cable 40 and the central electrode 26 via the terminal head 36, conductor lead 48, socket 44 and terminal 30. In the assembled condition, the coil spring 56 is held in compression with its lowermost turn abutting against the plug metal shell 22 thereby establishing a ground connection for the terminal 50*b* of the capacitor unit via the conductor 54. Whenever a high sparking voltage is applied across the central and ground electrodes 26 and 28 of the spark plug, ignition current flows through the terminal head 36, conductor 48, connector socket 44, plug terminal 30 and to the central electrode 26 on one hand, and through the terminal head 36, conductor 48 and into the capacitor unit 50 on the other. The capacitor is first fully charged by the application of the sparking potential, and is then discharged across the plug electrodes when a spark is caused thereacross by the applied potential with the result being much intensified spark jumping across the gap between the electrodes as hereinabove set forth. The structure of FIGS. 3–4 is advantageous in that the coil spring 56 employed is effective to keep and assure the desired ground connection between the capacitor unit 50 and the plug metal shell 22 under such conditions where the spark plug and the cap are subject to sever vibrations. The coil spring interposed between the spark plug and the cap also functions to dissipate heat from the engine before it is transferred to the insulating cap body. In addition, the embedded capacitor unit 50 is effectively protected against shock and vibration as well as against head and moisture. In designing and employing the coil spring 56, care should be taken to prevent arcing from occuring between adjacent turns of the coil spring since such arcing not only causes loss of electric energy stored in the capacitor unit but also might pose a danger to human beings who have access to the plug equipped engine for repair and maintenance services. For arc prevention, it is suggested to form the coil spring such that each and every turn of the spring is kept in intimate contact with adjacent turns or is spaced more than 5 millimeters (0.2 inch) away from adjacent turns. Or alternately, an insulating sleeve may be slipped around the coil spring. FIG. 5 shows in part a modified spark plug cap wherein a coil spring **56*a* with each flat coil turn kept in close contact with adjacent turns is employed in place of the "loose" coil spring 56 of FIG. 3**. In this coil spring, no arcing would occur between adjacent turns even if high-tension spark intensifying current is repeatedly passed through the coil due to the discharging of the capacitor unit. In addition, the closely nested turns of the coil spring serve to prevent dust and dirt from accumulating on the interconnection between the spark plug and the plug cap.

FIG. 6 shows another modification from the spark plug cap of FIGS. 3–4. In the modified spark plug cap, a resilient sleeve member 64 made of, for example, silicon rubber is forced within the coil spring 56 and is bonded or otherwise attached to the lower end of the insulating body 34. The resilient sleeve has a central bore for receiving the insulator body 24 of the spark plug. For the purpose as will be apparent from the description below, the central bore in the resilient sleeve 64 is preferably sized slightly smaller in diameter than the insulator body of the spark plug. With the above-mentioned arrangement, when the plug cap is fitted in position over the spark plug, the sleeve 64 is held in compression between the coil spring 56 and insulator body 24. The result is that the resilient sleeve grips securely around the insulator body for much assured mechanical interconnection between the spark plug and the cap. In addition, the same sleeve serves to prevent infiltration of dust and moisture into the plug cap.

In FIG. 7, there is illustrated a spark plug cap according to another embodiment of the invention. This plug cap is basically identical in construction with the plug cap of FIGS. 3–4 except that the terminal head 36 is omitted. In the absence of such terminal head, a high-tension ignition cable 40 from the ignition system is directly connected into the plug cap. As shown and generally known, the ignition cable 40 comprises an outer insulating sheath **40*a* and an inner stranded wire 40*b* encased in the insulating sheath. The ignition cable extends axially through the upper half of the insulating cap body with the lower end of the stranded wire 40*b* reaching the connector socket 44 in the cap body, while the outer sheath 40*a* terminating short of the socket. The stranded wire may be welded or otherwise connected to the socket. In the illustrated embodiment, a metal crimp ring 66 is integrally attached to the socket for mechanically as well as electrically connecting the stranded wire to the socket. The capacitor unit 50 is placed in position within the lateral recess 58 by filling out the recess with a suitable epoxy resin 60. One terminal 50*a* of the capacitor unit is directly connected to the socket 44, while other terminal 50*b* to the coil spring 56 via a conductor 54**.

Figure 8:
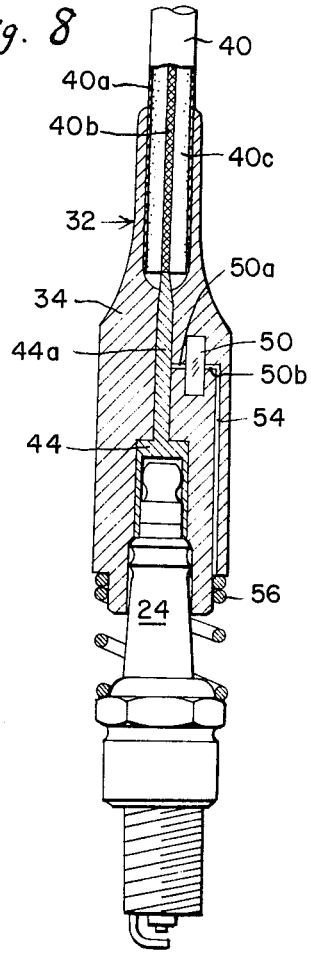
FIG. 8 is a vertical cross-sectional view of a spark plug cap of the invention similar to that shown in FIG. 7 but in which a planar capacitor unit is directly embedded within the insulating cap body.

In FIG. 8, a carbon impregnated cable 40 is used. The cable comprises an outer sheath **40*a* filled with compacted carbon 40*c* and a stranded wire 40*b* extending axially through the carbon filling within the sheath. The end portion of the cable 40 projects into the insulating cap body 34 for electrically connecting the stranded wire 40*b* with an elongated conductive extension 44*a* which is an integral part of the connector socket 44. In contrast with the spark plug cap of FIG. 7, a planar capacitor unit 50 is directly embedded within the insulating body 34 during molding of the same. The capacitor unit has one terminal 50*a* connected to the conductive extension 44*a* and the other terminal 50*b* to the coil spring 56 via the conductor lead 54**.

Figure 9:
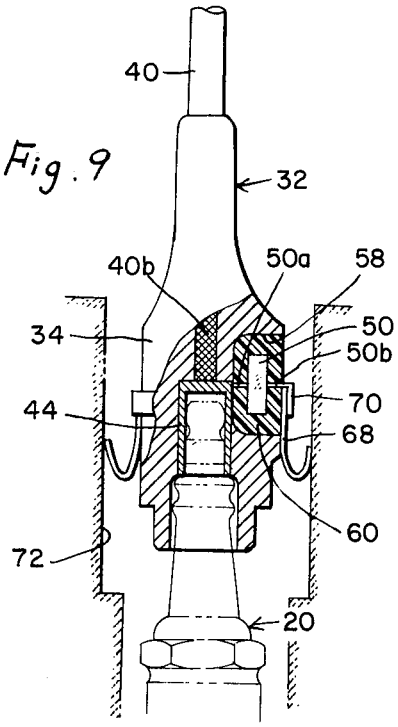
FIG. 9 is a side elevational view partly in cross-section of a spark plug cap of the invention similar to that shown in FIG. 8, in which a plurality of leaf springs are used for making ground connection to the flat built-in capacitor unit.

FIG. 9 illustrates a spark plug cap similar to that shown in FIG. 7. In place of the grounding coil spring 56, a plurality of hook shaped leaf springs 68 of a conductive metal are attached on the outer wall of the insulating cap body 34 by a conductive belt 70 which in turn is joined to one terminal **50*b* of the built-in capacitor unit 50. The other terminal 50*a* is connected to the socket 44. With this unique arrangement, when the plug cap is fitted on the spark plug 20, the leaf springs 68 on the outer wall of the cap body come into resilient engagement with the wall of plug receiving hole 72 in the engine cylinder head, thus establishing ground connection for the capacitor unit 50. The leaf springs also help to keep the plug cap in position within the plug receiving hole 72**.

Figure 10:
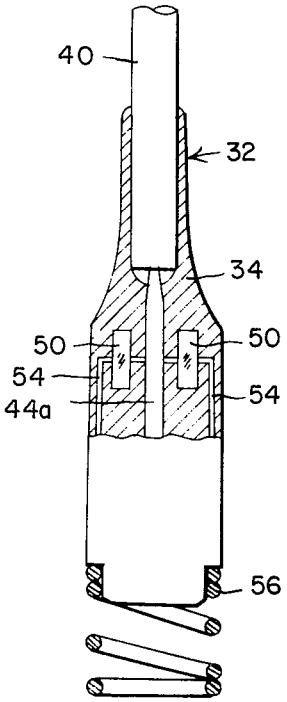
FIG. 10 is a side elevational view partly in cross-section of a spark plug cap embodying the invention wherein a pair of planar capacitor units are encased within the insulating body.

A spark plug cap illustrated in FIG. 10 is essentially identical in construction to that of FIG. 8 except that a pair of similar flat capacitor units 50 are embedded within the insulating cap body 34. Terminals **50*a* of the two capacitor units are connected to the conductive socket extension 44*a*, while other terminals 50*b* to the coil spring 56 via the grounding conductors 54**.

Figure 11:
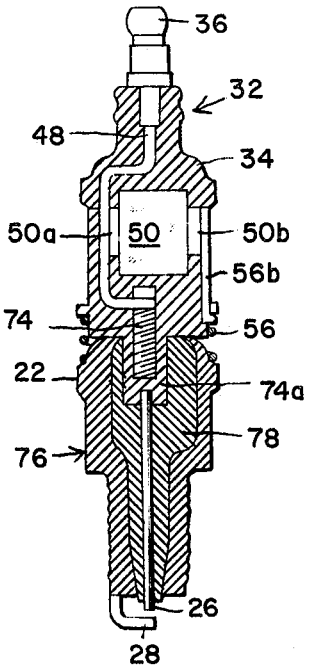
FIG. 11 is a vertical cross-sectional view of a spark plug cap embodying the invention in which a screwed interconnection is made between the insulating cap body with an encased flat capacitor unit and a spark plug member.

In FIG. 11, there is illustrated a screwed-in type spark plug cap according to further embodiment of the invention. The plug cap includes a generally cylindrical body 34 made of insulating material such as fiber reinforced plastics and ceramics. A conductive terminal 36 is attached at the top end of the insulating body 34, the bottom end of which is cut flat generally perpendicular to its axis. Axially studded in the center of the cap bottom is a conductive male screw member 74 to be used for the purpose hereinafter explained. An electric conductor 48 extends through the cap body to connect the terminal 36 with the screw member 74.

A capacitor unit 50 is entirely embedded within the cap body with one terminal **50*a* connected to the conductor 48. The other terminal 50*b* of the capacitor unit is electrically joined to an upright end 56*a* of the conductive coil spring 56 which is fixedly fitted around the lower end of the cap body. A mating spark plug member 76 is a modification of the existing spark plug. As shown, the spark plug member 76 generally corresponds in configuration to the lower half of the known spark plug and includes a metal shell 22 and a central electrode 26 extending axially through the metal shell. The central electrode is insulated from the shell 22 by an insulator body 78 disposed within the shell. A ground electrode 28 is fixed to the shell to form a spark gap between this electrode and the central electrode. As contrasted to the normal spark plug, a conductive female screw member 74***a* is embedded in the center of the upper end of the spark plug member in electrical contact with the central electrode 26. With this arrangement, the cap 32 may be rotated to thread the male screw member 74 into the female screw member 74*a* thereby detachably interconnecting the cap with the spark plug member. Under the assembled condition, the coil spring 56 is held in compression between the cap body 34 and the metal shell 22 to establish ground connection for the capacitor terminal 50*b*. The mating screw members 74 and 74*a* not only mechanically attach the plug cap and the spark plug member together but also make electrical connection between the terminal 36 and the central electrode 26 via the conductor 48.

Figure 12:
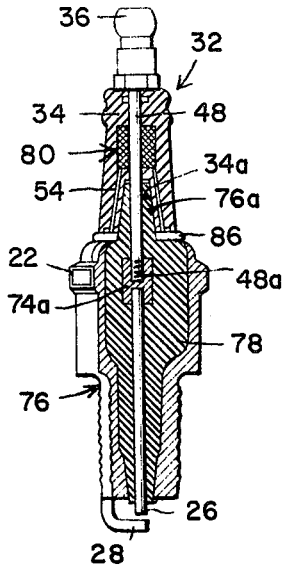
FIG. 12 is a vertical cross-sectional view of another screwed-in type spark plug cap of the invention in which a cylindrical capacitor unit is embedded within the insulating cap body.
Figure 13:
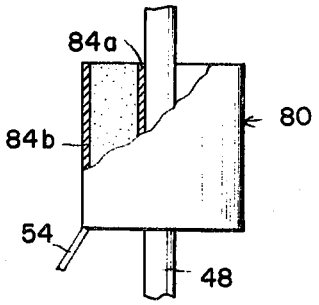
FIG. 13 is an enlarged view partly in cross-section of the cylindrical capacitor unit incorporated in the spark plug cap of FIG. 12.

Known flat type capacitors are used as the capacitor unit in all of the preceeding embodiments. However, capacitors other than the flat type may also be utilized to advantage. FIG. 12 shows a spark plug cap according to a still further embodiment of the invention in which a commercially available cylindrical capacitor is incorporated as the capacitor unit. The cap is a screwed-in type similar to that shown in FIG. 11 and includes a generally cylindrical insulating body 34 with a terminal 36 attached at its top end. An elongated conductor rod 48 extends from the terminal 36 axially through the insulating body 34 and slightly beyond the flat bottom thereof. A threaded portion 48*a* is provided at the lower end of the conductor rod for the purpose hereinbelow explained. Formed in the bottom end of the cap body 34 is a generally conical recess or cavity 34*a* for receiving a mating conical projection 76*a* made at the top end of a spark plug member 76. A cylindrical capacitor unit 80 is embedded within the cap body and, as shown more clearly in FIG. 13, includes a cylindrical dielectric 82 sandwitched between a pair of coaxially arranged cylindrical electrodes 84*a* and 84*b*. The cylindrical capacitor unit is slipped on the conductor rod 48 to make direct electrical contact between the inner electrode 84*a* and the conductor rod 48. A ground conductor lead 54 extends from the outer electrode 84*b* of the capacitor unit through the cap body and terminates at the bottom face thereof. A female screw member 74*a* is embedded in the spark plug member 76 in electrical connection with the central electrode 26. The conical projection 76*a* at the upper end of the spark plug member has an axially extending aperture formed therein for receiving the elongated conductor rod 48. With this arrangement, when desired to equip the plug member with the cap, the cap is first placed over the spark plug member so that the conductor rod 48 may extend through the aperture in the projection 76*a*. It should be noted at this point that a metal washer 86 is interposed between the cap bottom face and plug upper face. Thereafter, the cap is rotated to screw the threaded portion 48*a* of the conductor rod into the female screw member 74*a* thereby to establish the desired tight interconnection between the plug member and the cap one hand and the electrical connection between the conductor rod 48 and the spark plug electrode 26 on the other. At the same time, the metal washer 86 is held securely between the cap and the spark plug member in intimate contact with both the exposed end of the conductor lead 54 and the plug metal shell 22 making ground connection for the outer electrode 84*b* of the cylindrical capacitor unit.

Figure 14:
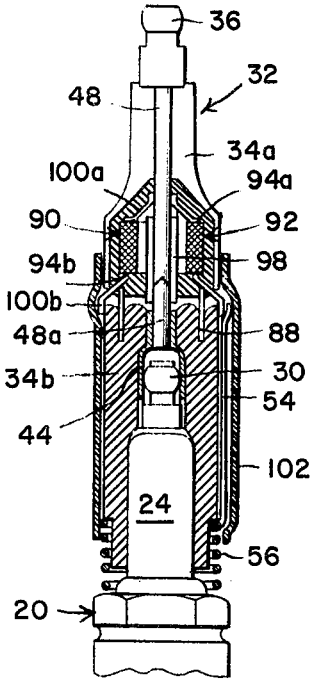
FIG. 14 is a vertical cross-sectional view of a spark plug cap of the invention in which a different cylindrical capacitor unit is incorporated.
Figure 15:
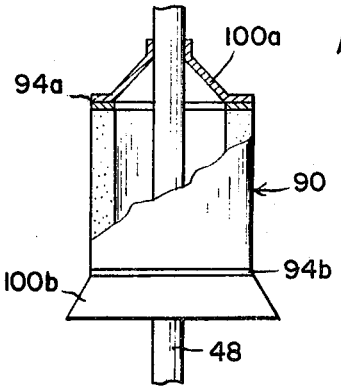
FIG. 15 is an enlarged view partly in cross-section of the cylindrical capacitor unit incorporated within the spark plug cap of FIG. 14.

In FIG. 14, there is illustrated a spark plug cap of the invention which has incorporated therein a cylindrical capacitor unit of a different construction. The cap 32 includes upper and lower insulating bodies 34*a* and 34*b* tightly interconnected together by an insulating coupling 88. A conductor rod 48 extends from the terminal head 36 axially through the upper insulating body 34*a*. The cylindrical capacitor unit 90 to be embedded within the upper insulating body comprises, as more clearly shown in FIG. 15, a cylindrical dielectric 92 and a pair of annular metal electrodes 94*a* and 94*b* fixedly attached to the upper and lower end faces of the cylindrical dielectric, respectively. It should be noted that the capacitor unit 90 is so disposed within the upper insulating body 34*a* that the cylindrical dielectric 92 may surround the upper conductor rod 48. Formed within the lower insulating body 34*b* is a generally cylindrical bare 96 for receiving the ceramic insulator 24 of the spark plug 20. A socket 44 for making both electrical and mechanical connection with the plug terminal 30 is also embedded within the lower insulating body 34*b* in intimate attachment to a lower conductor rod 48*a*. The lower conductor rod 48*a* is in turn kept in electrical contact with the upper conductor rod 48 by a metal coupler 98. A ground conductor lead 54 disposed on the outer wall of lower insulating body 34*b* is joined at its lower end to the coil spring 56 which is fitted around the bottom of the insulating body. In order to place the cylindrical capacitor unit 90 in parallel circuit with respect to the spark plug gap, the upper electrode of the capacitor is connected to the upper conductor rod 48 via an upper conductor ring 100*a*, while the lower electrode 94*b* to the ground conductor 54 via a lower conductor ring 100*b*. The reference numeral 102 indicates an insulating protective sleeve fitted around the spark plug cap for the known purpose. The fact that the cylindrical capacitor units can be disposed in the center of the insulating body makes it possible to provide spark plug caps of compact design.

As will be understood from the foregoing description, by using the novel plug caps of the invention on the spark plugs, sparking across the spark plug gap is much intensified in strength. In fact, it has been found that the ignition current jumping across the gap of a cap fitted spark plug is more than 30 times as much as the ignition current across the gap of a spark plug without a cap of the invention.

Generation of much intensified spark across the gap effects ready and almost complete combustion of the fuel-air mixture in the cylinder resulting in a greatly improved engine output power, accelerative force and mileage. As to the mileage of automobiles, it has been found that it is improved by approximately 20 to 30% when the spark plug caps of the invention are utilized. Almost complete combustion of the fuel charge initiated by the intensified spark produces relatively clean combustion gases with reduced carbon monoxide and hydrocarbon content. This is particularly advantageous nowadays when strict antipollution control is called for throughout the world. The data entered in the table below manifest how much carbon monoxide and hydrocarbon content of combustion by-product gases is reduced when the novel plug caps of the invention are used on the spark plugs of the internal combustion engine. Three automobile engines of different total piston displacement are put to the test to determine carbon monoxide and hydrocarbon contents in the exhaust gases from the engines with or without the plug caps fitted on the spark plugs.

| Types of Engines Tested (Total in Piston Displacement) | CO content in % | | | HC content in PPM | | |
|---|---|---|---|---|---|---|
| | Without Plug Caps | With Plug Caps | Reduction Percentage | Without Plug Caps | With Plug Caps | Reduction Percentage |
| A (2,000 cc) | 1.8 | 1.2 | 33.0 | 550 | 450 | 18.2 |
| B (1,800 cc) | 2.2 | 1.5 | 31.8 | 625 | 460 | 26.9 |
| C (1,600 cc) | 2.6 | 1.7 | 34.6 | 630 | 460 | 25.0 |
| D (1,400 cc) | 3.5 | 2.5 | 28.5 | 750 | 530 | 53.3 |

As is apparent from the foregoing description, novel spark plug caps are provided according to the invention, which can be readily fitted on the commonly used spark plugs for the internal combustion engine to greatly augment or intensify ignition starting sparks across the spark plug gaps. The spark across the gap is intensified by the discharging of a charged capacitor across the gap, which itself is initiated when sparking takes place across the gap. It has also be found that the spark jumps across the gap in the form of a bold pillar in the cap fitted spark plug, while in the spark plug without the cap the spark is in the form of a thin thread. Generation of such intensified sparks across the spark plug gap assures almost complete combustion of the fuel charge in the engine cylinder, the desired results of which are already discussed above. In addition, intensified sparks effectively burn out carbon or other deposites on the plug electrodes and on the cylinder wall thus rendering the cap fitting spark plugs self-cleaning type. Further, nearly perfect combustion taking place in the engine cylinder is advantageous in that it substantially reduces the formation of incomplete combustion gases which are known to have detrimental effects on lubricating oil in the oil pan.

The spark plug caps of the invention are simple in construction and inexpensive in manufacturing cost. The major component part is a capacitor unit placed in parallel circuit to the spark plug gap. Capacitor units suitable for use in the plug caps of the invention are readily available in the market, and rigid in construction and stable in performance.

What we claim is:

1. A spark plug cap for electrically and mechanically connecting a spark plug to an ignition current supply cord to intensify sparking across the gap between central and ground electrodes of the spark plug, which comprises:

an insulating body, said insulating body including means for mechanically connecting said cap to said spark plug and terminal means adapted to be connected to said supply cord;

electrically conductive means extending through said insulating body to electrically connect said terminal means to said central electrode of said spark plug; and at least one capacitor unit embedded essentially entirely within said body and electrically connected in parallel to said spark gap, said capacitor unit comprising an essentially flat capacitor having a flat dielectric base and a pair of electrodes attached on the opposite sides of said dielectric base.

2. A spark plug cap according to claim 1 wherein said insulating body is formed with a lateral recess adapted to retain said capacitor unit, said lateral recess being filled with an insulating material to surround said capacitor unit and retain said capacitor unit therein.

3. A spark plug cap according to claim 2 wherein said insulating body is made of a member selected from the group consisting of fiber reinforced plastics, epoxy resin, silicone rubber and ceramic material.

4. A spark plug cap according to claim 2 which includes a plurality of capacitor units and an equal number of lateral recesses for supporting said capacitor units.

5. A spark plug cap according to claim 4 wherein said plurality of capacitor units are arranged with generally geometrical symmetry with respect to said electrically conductive means.

6. A spark plug cap according to claim 1 wherein said cap capacitor electrode is electrically coupled to said electrically conductive means and the other capacitor electrode is electrically coupled to the ground electrode of the spark plug.

7. A spark plug cap according to claim 6 which further includes:

an electrically conductive lead embedded in said insulating body, said electrically conductive lead coupled at one end to said other capacitor electrode; and an electrically conductive coil spring electrically coupling the other end of said electrically conductive lead with the ground electrode of said spark plug.

8. A spark plug cap according to claim 1 wherein adjacent turns of said coil spring are spaced apart more than about 5 millimeters.

9. A spark plug cap according to claim 1 which further includes a generally resilient sleeve adapted to surround the spark plug when said cap is attached thereto.

10. A spark plug cap according to claim 7 wherein adjacent turns of said coil spring are in essentially intimate contact.

11. A spark plug cap according to claim 1 wherein one of said capacitor electrodes is electrically coupled to said electrically conductive means and the other capacitor electrode is electrically coupled to the ground electrode of the spark plug by generally hook-shaped leaf springs engageable with the inner wall of a plug receiving cavity formed in the internal combustion engine in which the spark plug is mounted.

12. A spark plug cap for electrically and mechanically connecting a spark plug to an ignition current supply cord to intensify sparking across the gap between central and ground electrodes of the spark plug, which comprises:

an insulating body, said insulating body having means for mechanically connecting said cap to said spark plug and terminal means adapted to be connected to said supply cord;

electrically conductive means extending through said insulating body to electrically connect said terminal means to the central electrode of said spark plug; and at least one generally cylindrical capacitor unit embedded within said insulating body and electrically connected in parallel to said spark plug gap, said capacitor unit including an essentially cylindrical dielectric through which said conductive means extends and a pair of electrodes positioned on the opposite end faces of said cylindrical dielectric base.

13. A spark plug cap according to claim 1 wherein said insulating body is made of a member selected from the group consisting of fiber reinforced plastics, epoxy resin, silicone rubber and ceramic material.

14. A spark plug cap according to claim 1 wherein one electrode of said capacitor unit is electrically connected to said electrically conductive means and the other electrode is electrically coupled to the ground electrode of the spark plug.

15. A spark plug cap according to claim 14 which further includes:

a first electrically conductive lead electrically coupling said one capacitor electrode to said electrically conductive means;

a second electrically conductive lead embedded in said insulating body, said second lead having one end electrically coupled to said other capacitor electrode; and an electrically conductive coil spring electrically coupling the other end of said second electrically conductive lead with the ground electrode of said spark plug.

16. A spark plug cap according to claim 15 wherein adjacent turns of said coil spring are spaced apart more than about 5 millimeters.

17. A spark plug cap according to claim 15 wherein adjacent turns of said coil spring are in essentially inimate contact.

18. A spark plug cap for electrically and mechanically connecting a spark plug to an ignition current supply cord to intensify sparking across the gap between central and ground electrodes of the spark plug, which comprises:

an insulating body, said insulating body having means for mechanically connecting said cap to said spark plug and terminal means adapted to be connected to said supply cord;

electrically conductive means extending through said insulating body to electrically connect said terminal means to the central electrode of said spark plug;

at least one capacitor unit supported within said body and electrically connected in parallel to said spark gap, one electrode of said capacitor unit being electrically connected to said electrically conductive means;

an electrically conductive lead connected to the other capacitor electrode and adapted to be electrically coupled to the ground electrode of the spark plug; and an electrically conductive coil spring electrically connecting said electrically conductive lead with the ground electrode of said spark plug.

19. A spark plug cap according to claim 18 wherein adjacent turns of said coil spring are spaced more than about 5 millimeters apart.

20. A spark plug cap according to claim 18 wherein adjacent turns of said coil spring are in essentially intimate contact.

21. A spark plug cap for electrically and mechanically connecting a spark plug to an ignition current supply cord to intensify sparking across the gap between central and ground electrodes of the spark plug, which comprises:

an insulating body, said insulating body having means for mechanically connecting said cap to said spark plug and terminal means adapted to be connected to said supply cord;

electrically conductive means extending through said insulating body to electrically connect said terminal means to the central electrode of said spark plug;

at least one capacitor unit supported within said insulating body and electrically connected in parallel to said spark gap; and grounding means for electrically coupling said capacitor unit to the ground electrode of said spark plug, said grounding means including at least one electrically conductive spring member adapted to engage the inner wall of a plug receiving cavity formed in the internal combustion engine in which the spark plug is mounted.

22. A spark plug cap according to claim 21 wherein each electrically conductive spring member comprises a generally hook-shaped leaf spring.

* * * * *